US005730013A

United States Patent [19]

Huang

[11] Patent Number: 5,730,013

[45] Date of Patent: Mar. 24, 1998

[54] KEY STRUCTURE WITH ILLUMINATION FUNCTION

[76] Inventor: Wen-Sheng Huang, No. 33, Chiumao Rd., Hsin Fu Li, Tung Hsiao Chen, Miao Li Hsien, Taiwan

[21] Appl. No.: 832,003

[22] Filed: Apr. 2, 1997

[51] Int. Cl.[6] ..... E05B 19/02

[52] U.S. Cl. ..... 70/395; 70/404; 70/408; 70/454; 362/116; 362/200

[58] Field of Search ..... 70/456 R, 408, 70/395, 403, 404, 453, 454, 278, DIG. 51; 362/116, 100, 200

[56] References Cited

U.S. PATENT DOCUMENTS

| | | | |
|---|---|---|---|
| 2,208,498 | 7/1940 | Cramer | 362/116 |
| 4,521,833 | 6/1985 | Wolter | 362/116 |
| 4,562,712 | 1/1986 | Wolter | 70/395 |
| 5,181,927 | 1/1993 | Song | 362/116 |
| 5,307,658 | 5/1994 | Kokubu et al. | 70/408 X |
| 5,402,660 | 4/1995 | Osada | 70/404 X |
| 5,541,817 | 7/1996 | Hung | 362/116 |

FOREIGN PATENT DOCUMENTS

| | | | |
|---|---|---|---|
| 265663 | 10/1913 | Germany | 362/100 |
| 1588720 | 4/1981 | United Kingdom | 362/100 |

*Primary Examiner*—Lloyd A. Gall
*Attorney, Agent, or Firm*—Bacon & Thomas

[57] ABSTRACT

A key structure with illumination function including a grip housing composed of a first and a second casing, a key plate enclosed in the grip housing and having a key head extending out of the grip housing, a cell disposed beside the key plate and a light emitting diode having two terminals extending to two electrodes of the cell. By depressing a depression button, the terminals of the light emitting diode are electrically connected with the cell to form a closed circuit so that the light emitting diode can emit a light beam to illuminate the circumference of the key hole. Accordingly, in a dim place, a user can easily use the key to unlock the lock.

9 Claims, 3 Drawing Sheets

KEY STRUCTURE WITH ILLUMINATION FUNCTION

BACKGROUND OF THE INVENTION

The present invention relates to a key structure with illumination function, and more particularly to a key structure disposed with a cell and a light emitting means which can be electrically connected with the cell by means of depressing a depression button. The cell serves to power on the light emitting means to emit a light beam to illuminate the circumference of the key hole, whereby in a dim place, a user can easily use the key to unlock the lock.

A conventional key structure has a key plate for extending into a key hole to unlock a lock. The rear end of the key plate is coated by a cover member for easy grip. Such key structure is not equipped with any illumination device so that it is difficult to insert the key into the key hole in a dim place without additional light source. It is troublesome to carry a flashlight or other light emitting device for unlocking the lock.

SUMMARY OF THE INVENTION

It is therefore a primary object of the present invention to provide a key structure with illumination function including a grip housing composed of a first and a second casing, a key plate enclosed in the grip housing and having a key head extending out of the grip housing, a cell disposed beside the key plate and a light emitting diode having two terminals extending to two electrodes of the cell. By means of depressing a depression button, the terminals of the light emitting diode are electrically connected with the cell to form a closed circuit so that the light emitting diode can emit a light beam to illuminate the circumference of the key hole. Accordingly, in a dim place, a user can easily use the key to unlock the lock.

It is a further object of the present invention to provide the above key structure in which the first casing is disposed with a locating block for inserting into a locating hole of the key plate to firmly associate the key plate with the grip housing. The first casing is further formed with an arch rib for retaining an assembly of the key plate and the cell, whereby the key plate is able to bear the torque during unlocking procedure.

The present invention can be best understood through the following description and accompanying drawings, wherein:

DETAILED DESCRIPTION OF THE PREFERRED EMBODIMENT

Figure 1:
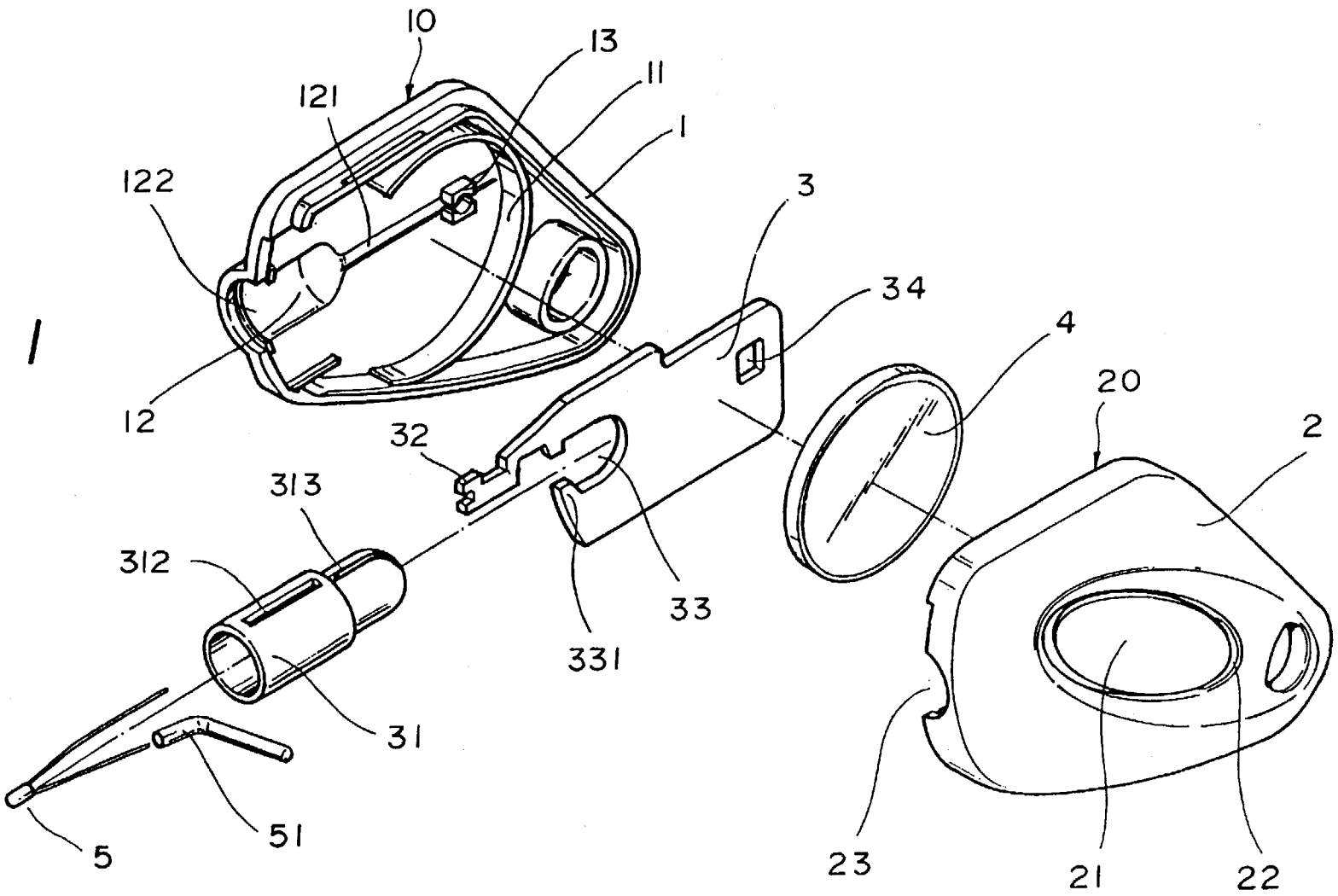
FIG. 1 is a perspective exploded view of the present invention.

Please refer to FIG. 1. The present invention mainly includes a grip housing 1, a key plate 3, a cell 4 and a light emitting diode 5. The grip housing 1 is composed of a first casing 10 and a second casing 20. An arch rib 11 is disposed in the first casing 10. A middle section of the inner wall of the first casing 10 is formed with a channel 121. One end of the channel 121 is communicated with a cylindrical chamber 12 which is communicated with an outer side via an arch opening 122. The other end of the channel 121 is disposed with a pair of locating blocks 13. The second casing 20 is similar to the first casing 1 and formed with an arch opening 23 corresponding to that of the first casing 10. The middle section of the second casing 20 is connected with a depression button 21 via a connecting section 22. The depression button 21 can be restorably retracted inward by external force. The rear end of the key plate 3 is formed with a locating hole 34, while the front end thereof is formed with a U-shaped notch 33. Each side of the opening of the notch 33 is formed with an inward projection 331. A clip section 32 forward projects from the upper side of the notch 33 for extending into a tube-like key head 31. A slit 312 is formed on one side of the key head 31 for the clip section 32 to insert and locate therein. The near end of the key head 31 is formed with a locating slot 313 for the projections 331 of the notch 33 to insert therein and clip the key head 31, The inner side of middle section of the key head 31 is disposed with a locating diaphragm 311. One of the terminals of the light emitting diode 5 is coated by an insulative sleeve 51.

Figure 4:
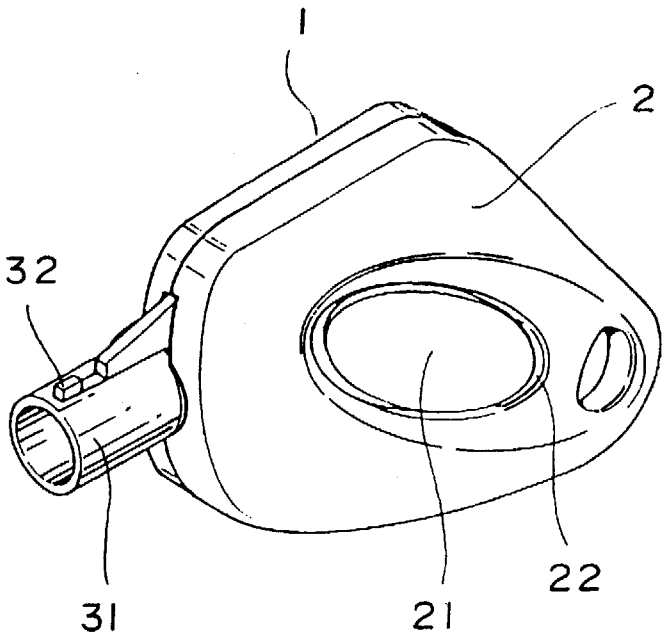
FIG. 4 is a perspective assembled view of the present invention.
Figure 2:
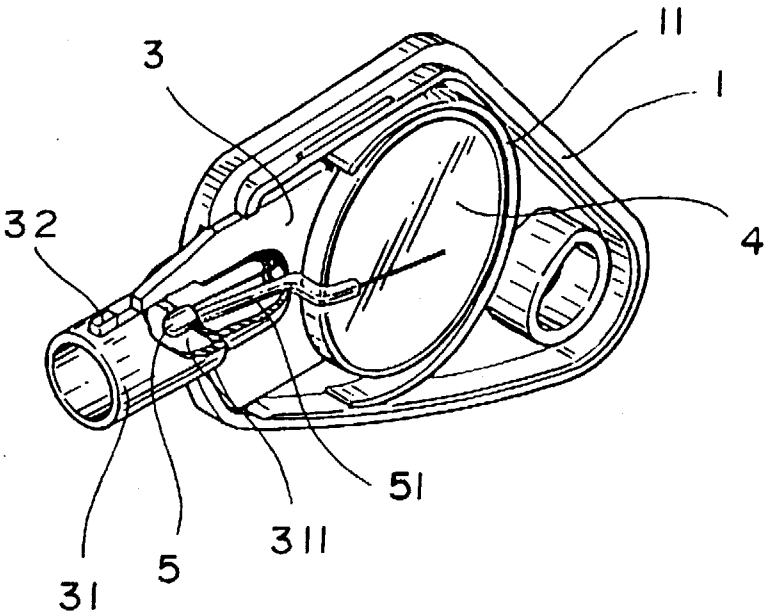
FIG. 2 is a perspective assembled view of a part of the present invention.
Figure 3:
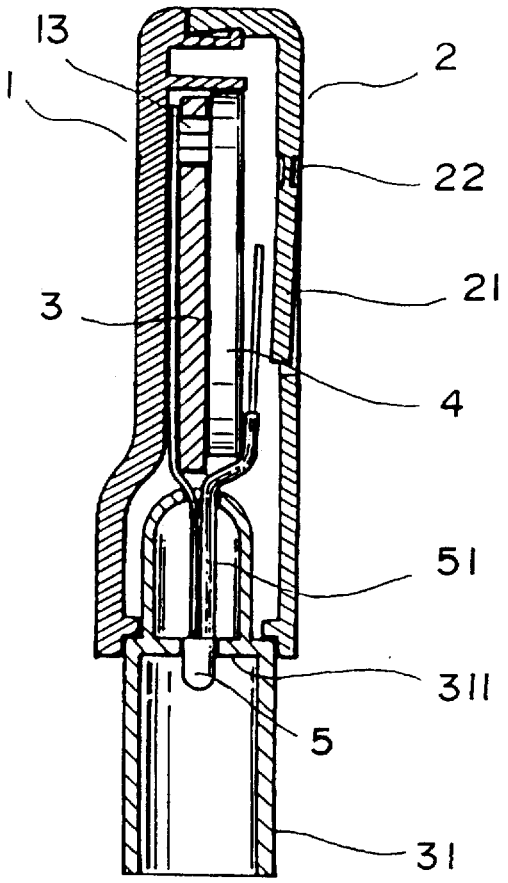
FIG. 3 is an assembled sectional view of the present invention.

Referring to FIGS. 2, 3 and 4, the clip section 32 of the key plate 3 is extended into the slit 312 of the key head 31 and slid forward. The two projections 331 of the key plate 3 are inserted into the locating slot 313 of the key head 31 so as to firmly associate the key plate 3 and the key head 31. One electrode of the cell 4 attaches to and contacts with the key plate 3. The light emitting diode 5 is located on the locating diaphragm 311 of the key head 31. The two terminals of the diode extend out of the rear end of the key head 31. The terminal coated with the insulative sleeve 51 extends to one side of the cell 4, which does not contact with the key plate 3. By means of the isolation and retaining of the insulative sleeve 51, the terminal is spaced from the cell by a small gap. The other terminal of the light emitting diode 5 directly contacts with the key plate 3. By means of the electrical conductivity of the metal key plate 3, the other terminal of the diode 5 is electrically connected with the other electrode of the cell 4. The key plate 3 and cell 4 are enclosed in the first and second casings 10, 20 with the locating blocks 13 of the first casing 10 inserted in the locating hole 34 of the key plate 3. The arch rib 11 abuts against the periphery of the assembly of the key plate 3 and the cell 4. The key head 31 is received in the chamber 12 of the first casing 10 and extends out of the arch openings 122, 23 of the first and second casings 10, 20.

In use, the depression button 21 is pressed inward to push one terminal of the diode 5 to contact with the cell 4. The other terminal of the diode 5 originally contacts with the key plate 3 so that by means of the electrical conductivity of the key plate 3, the cell 4 and the light emitting diode 5 form a close circuit. Therefore, the light emitting diode 5 is powered on to emit a light beam out of the front end of the key head 31. Accordingly, when getting close to the key hole, the key can illuminate the circumference thereof in a dim place so as to avoid trouble in unlocking the lock.

It should be noted that the above description and accompanying drawings are only used to illustrate one embodiment of the present invention, not intended to limit the scope thereof. Any modification of the embodiment should fall within the scope of the present invention.

What is claimed is:

1. A key structure with illumination function, comprising:

a key plate having a front end with which a key head is engaged for extending into a key hole, a middle section of the key head being disposed with a locating diaphragm;

a cell;

a light emitting means disposed on the locating diaphragm of the key head, two terminals of the light emitting means being respectively extended to two electrodes of the cell, one of the terminals being spaced from the cell in normal state and able to contact with the cell when depressed; and a grip housing composed of a first and a second casing for enclosing the above elements, one side of the grip housing being disposed with a movable depression button adjacent to one side of the cell, whereby by means of depressing the depression button, the spaced terminal of the light emitting means is pushed to contact with the electrode of the cell to form a closed circuit, enabling the light emitting means to provide illuminating effect.

2. A key structure as claimed in claim 1, wherein a rear end of the key plate is disposed with a locating hole and the first casing is disposed with a locating block corresponding to the locating hole for inserting therein so as to firmly associate the key plate with the grip housing.

3. A key structure as claimed in claim 1, wherein the key plate is made of metal material and directly contacts with one electrode of the cell, the terminals of the light emitting means being respectively extended to the key plate and the other electrode of the cell.

4. A key structure as claimed in claim 1, wherein an arch rib is formed inside the first casing for locating the assembly of the key plate and the cell.

5. A key structure as claimed in claim 1, wherein the depression button is connected with the second casing via a connecting section.

6. A key structure as claimed in claim 1, wherein the light emitting means is a light emitting diode.

7. A key structure as claimed in claim 6, wherein one terminal of the light emitting means is coated by an insulative sleeve and extended to one electrode of the cell without contacting therewith in normal state, the other terminal of the light emitting means being extended to the key plate and electrically connected with the key plate and the other electrode of the cell.

8. A key structure as claimed in claim 6, wherein the grip housing is composed of the first and second casings.

9. A key structure as claimed in claim 6, wherein the key head is a tube-like body and the locating diaphragm is disposed at the middle section thereof for retaining the light emitting means.

* * * * *